US005243258A

United States Patent [19]

Garbowicz

[11] Patent Number: 5,243,258

[45] Date of Patent: * Sep. 7, 1993

[54] FLUORESCENT LAMP ELECTRODE DISCONNECT ARRANGEMENT

[75] Inventor: Glenn D. Garbowicz, Rosemont, Ill.

[73] Assignee: North American Philips Corporation, New York, N.Y.

[ * ] Notice: The portion of the term of this patent subsequent to Dec. 29, 1993 has been disclaimed.

[21] Appl. No.: 753,280

[22] Filed: Aug. 30, 1991

[51] Int. Cl.[5] ..... H05B 41/36

[52] U.S. Cl. ..... 315/106; 315/97; 315/98; 315/101; 315/105; 315/DIG. 5

[58] Field of Search ..... 315/106, 101, 105, 107, 315/DIG. 5, 97, 98

[56] References Cited

U.S. PATENT DOCUMENTS

| | | | |
|---|---|---|---|
| 3,904,921 | 9/1975 | Imaizumi et al. | 315/101 |
| 4,010,399 | 3/1977 | Bessone et al. | 315/106 X |
| 4,145,638 | 3/1979 | Kaneda | 315/101 X |
| 4,339,690 | 7/1982 | Regan et al. | 315/101 X |
| 4,399,391 | 8/1983 | Hammer et al. | 315/244 |
| 4,661,745 | 4/1987 | Citino et al. | 315/106 |
| 4,947,086 | 4/1990 | Nagano | 315/98 X |
| 4,954,749 | 9/1990 | Crawford | 315/106 X |
| 5,013,970 | 5/1991 | Crawford | 315/106 |

FOREIGN PATENT DOCUMENTS

| | | | |
|---|---|---|---|
| 0018082 | 2/1977 | Japan | 315/106 |

*Primary Examiner*—Eugene R. LaRoche
*Assistant Examiner*—Son Dinh
*Attorney, Agent, or Firm*—Edward Blocker

[57] ABSTRACT

A fluorescent lamp system including a ballast with primary and secondary windings and a switch for each of the plurality of electrodes of the lamp system. Each switch is operable in response to the voltage across its associated lamp after its associated lamp turns on to interrupt the connection of an associated electrode to its associated heater winding, and wherein at least two of the plurality of switches conduct current which flows through a semiconductor conducting device before the lamps turn on.

22 Claims, 1 Drawing Sheet

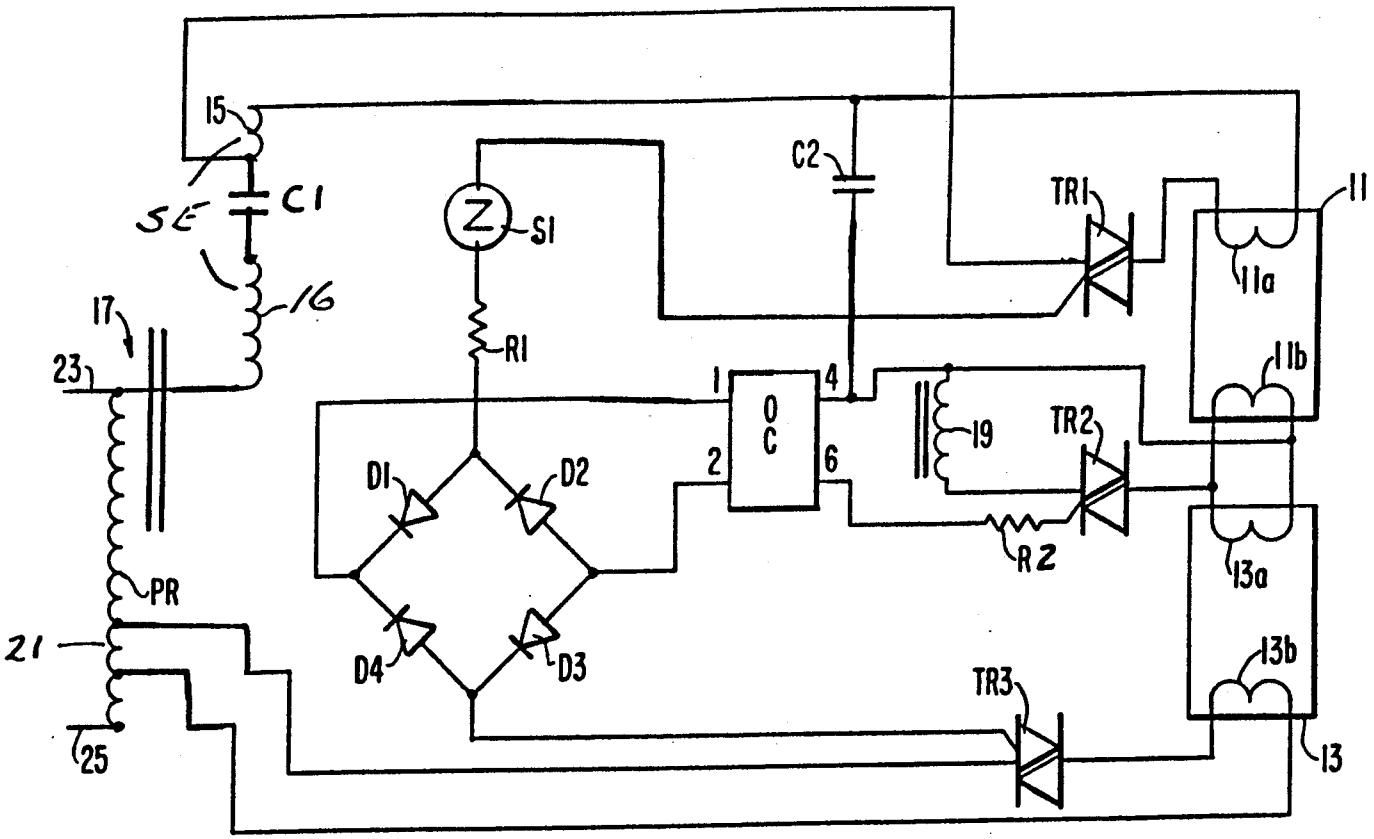
11
11a
11b
13
13a
13b
TR1
TR2
TR3
R2
19
C2
4
6
O
C
1
2
D2
D3
D1
D4
S1
R1
C1
16
15
SE
17
23
PR
21
25

FLUORESCENT LAMP ELECTRODE DISCONNECT ARRANGEMENT

BACKGROUND OF THE INVENTION

This is an invention in lighting. More particularly, it involves an arrangement for conserving power in the operation of fluorescent lamp systems.

This application is related to U.S. patent application Ser. No. 629,868, filed Dec. 19, 1990 and U.S. patent application Ser. No. 673,692 filed, Mar. 21, 1991 both of which are assigned to the same assignee as this application. Both of these applications are hereby incorporated by reference herein.

It is desirable to decrease the power expended by fluorescent lamps by shutting off the current to the heater electrodes of such lamps after ignition. In the past a number of arrangements for doing this have been proposed. Some of these use relays (see U.S. Pat. No. 4,661,745 to Citino et al and U.S. Pat. No. 4,954,749 to Crawford). Relays can be noisy and are subject to wear. The use of a filament transformer has also been proposed (see U.S. Pat. No. 4,399,391 to Hammer et al). Arrangements with filament transformers require auxiliary protection against excessive currents which can be developed in case a lamp electrode is damaged and the lamp acts in the manner of a rectifier.

SUMMARY OF THE INVENTION

It is an object of this invention to provide an improved arrangement for discontinuing heater electrode current flow in fluorescent lamps after the lamps are ignited.

One of the features of the invention is that it responds to the decrease in voltage across the lamps of a two lamp rapid start fluorescent lamp system which takes place after lamp ignition.

One of the advantages of the invention is that it decouples all of the filaments of a rapid start fluorescent lamp system from the filament windings upon ignition of the fluorescent lamps of the system. This makes a portion of the secondary winding available as a filament winding without the fear of it generating uncontrollable voltage during lamp operation.

In accordance with one embodiment of the invention, there is provided a fluorescent lamp system comprising a fluorescent lamp having a pair of electrodes. A ballast is provided for connection to a proper source of voltage. The ballast includes a primary winding and a secondary winding. The ballast, when connected to a proper source of voltage, provides a voltage across the lamp. The ballast includes a pair of electrode heater windings. At least one of the electrode heater windings comprises a portion of the secondary winding. A pair of semiconductor switches is provided, each of which connects one of the electrode heater windings to a respective lamp electrode. Control means is connected across the lamp and responds to the voltage across the lamp when the lamp is on to render each of the semiconductor switches non-conductive whereby no current can flow through said lamp electrodes. The control means responds to the voltage across the lamp when the lamp is off to render each of the semiconductor switches conductive. The pair of semiconductor switches conduct current which flows through the control means when the lamp is off.

In accordance with another aspect of the invention, there is provided a rapid start fluorescent lamp system comprising a plurality of fluorescent lamps each having a pair of electrodes. A ballast is provided for connection to a proper source of voltage. The ballast includes a primary winding and a secondary winding. The ballast, when connected to a proper source of voltage, provides a voltage across the lamps. The ballast includes a plurality of electrode heater windings for applying heating voltage to the electrodes of the fluorescent lamps. At least one of the electrode heater windings comprises a portion of the secondary winding. A plurality of switches are provided for connecting the electrode heater windings to the lamp electrodes. Control means is included which is connected across the lamps and is responsive to the voltage across the lamps when the lamps are on to render each switch non-conductive whereby no current can flow through said lamp electrodes. The control means is also responsive to the voltage across the lamps when the lamps are off to render each switch conductive. At least two of the plurality of switches conduct current which flows through the control means when the lamps are off.

In accordance with a still further aspect of the invention there is provided a fluorescent lamp system comprising a fluorescent lamp having a pair of electrodes. A ballast is provided for connection to a proper source of voltage. The ballast includes a primary winding and a secondary winding. The ballast, when connected to a proper source of voltage, provides a voltage across the lamp. The ballast includes a pair of electrode heater windings. One of said electrode heater windings comprises s part of the primary winding and one of said electrode heater windings comprises a part of the secondary winding. A pair of switches is provided, each connecting one of the electrode heater windings to a respective lamp electrode. Control means is connected across the lamp and responds to the voltage across the lamp when the lamp is off to conduct current, which current flows through each switch and renders each conductive.

BRIEF DESCRIPTION OF THE DRAWING

Other objects, features and advantage of the invention will be apparent from the following description and appended claims when considered in conjunction with the accompanying drawing in which:

the sole Figure is a schematic circuit diagram of one embodiment of the invention in a two-lamp rapid start fluorescent system.

DESCRIPTION OF THE PREFERRED EMBODIMENTS

Referring to the Figure there is shown therein two fluorescent lamps 11 and 13 each having a pair of electrodes 11*a*, 11*b* and 13*a*, 13*b*, respectively. Electrode 11*a* is connected across heater winding 15 which forms a part of the secondary winding SE of autotransformer 17. This connection is through triac TR1. Electrodes 11*b* and 13*a* are connected through triac TR2 across heater winding 19 of transformer 17. Electrode 13*b* is connected through triac TR3 across winding 21 which forms a part of primary winding PR of transformer 17.

As is typical, primary winding PR is connected to secondary winding SE. Capacitor C1 connects both parts of secondary windings SE, i.e. 15 and 16 together and provides power factor correction. This combination of elements is connected across lamps 11 and 13 which receive operating voltage therefrom. Such an operating voltage will be supplied when primary winding PR is connected to a proper source of voltage through lines 23 and 25.

Starting capacitor C2 is connected across lamp 11 in order for lamp 13 to start first and lamp 11 to follow in sequence thereafter.

A circuit comprising sidac S1, resistor R1 and a diode bridge comprising diodes D1–D4 is connected from the gate of triac TR1 to the gate of triac TR3. Connected across the diode bridge are the inputs 1 and 2 of optical coupler OC. As is well known a photodiode is connected across the input terminals 1 and 2 of optical coupler OC. As is also well known a light activated triac is connected across the output terminals 4 and 6 of optical coupler OC. In this way optical coupler OC provides electrical isolation between the diode bridge D1–D4 and the circuitry the light activated triac is connected to. This light activated triac of optical coupler OC is connected through resistor R2 to the gate of triac TR2 to render triac TR2 separately controlled. Signals for the gate of triac TR2 are generated by the voltages across electrode winding 19. The main conduction paths of triacs TR1, TR2 and TR3 are connected in series with heater windings 15, 19 and 21 and their respective lamp electrodes 11*a*, 11*b* and 13*a*, and 13*b*.

The control means comprising sidac S1, resistor R1 and the diode bridge formed by diodes D1–D4, as mentioned earlier, is connected directly to the gates of triacs TR1 and TR3 and through electrode 13*b* of lamp 13 to winding 21. With this arrangement an optical coupler is not required for triacs TR1 and TR3. The control means comprising the circuitry containing sidac S1, diode bridge D1–D4 and the optical coupler OC enable triacs TR1, TR2 and TR3 to provide heating power to the electrodes of lamps 11 and 13 to enable them to ignite, and upon ignition the control means responds to the reduction in the voltage across the lamps to render triacs TR1, TR2 and TR3 non-conductive.

In operation, when a proper voltage is applied across lines 23 and 25 to primary PR of autotransformer 17, a sufficient pre-ignition voltage is applied to sidac S1 for it to breakover. This permits conduction of a parasitic current from one anode of triac TR1 to its gate. This current flows through sidac S1, resistor R1, the diode bridge formed by diodes D1–D4 and through the gate and one anode of triac TR3. As a result the photodiodes in optical coupler OC connected in series across the diode bridge emit light and turn on the light activated triac of optical coupler OC. This enables current to flow from heater winding 19 through resistor R2 to the gate of triac TR2.

In addition, the forementioned parasitic current turns on both triacs TR1 and TR3. As a result, triacs TR1, TR2 and TR3 are rendered conductive and permit heater windings 15, 19 and 21 to provide heating current to electrodes 11*a*, 11*b*, 13*a*, and 13*b* of lamps 11 and 13. Upon heating sufficiently electrodes 13*a* and 13*b* will start conduction in lamp 13 to be followed shortly thereafter by conduction in lamp 11. Upon lamps 11 and 13 conducting the voltage across the lamps and across sidac S1 is no longer high enough to allow sidac S1 to continue to conduct. As a consequence the light emitting diode of optical coupler OC no longer has voltage applied to it and can no longer emit light. As a consequence the light activated triac of optical coupler OC ceases to conduct and no longer provides a signal to the gate of triac TR2 which consequently ceases conducting. Triacs TR1 and TR3 also cease conduction when sidac S1 ceases conduction. As a result the electrodes lamps 11 and 13 are no longer provided with current from heater windings 15, 19 and 21 with the consequent preservation of power which otherwise would be consumed.

In a contemplated embodiment, sidac S1 was chosen to have a 300 volts breakover voltage to enable conduction through resistor R1 and diodes D1–D4. Resistor R1 was selected to limit the current through the diode bridge to between 5 and 10 milliamps, which met the specification for the photodiode of optical coupler OC which was made by Motorola & Harris Semiconductor Co. catalog number MOC3012. Triacs TR1 and TR3 for this embodiment were made by Teccor Co. catalog number L201E3 Triac TR2 was a Teccor catalog number Q201E3. In this embodiment a total savings of about five (5) watts of power was experienced for both lamps.

As those skilled in the art will appreciate, while only one type of ballast arrangement has been specifically disclosed herein, the invention described will operate with various other ballast arrangements.

It should be apparent that modifications of the above will be evident to those skilled in the art and that the arrangements described herein are for illustrative purposes and are not to be considered restrictive.

What is claimed is:

1. A fluorescent lamp system for a fluorescent lamp having a pair of electrodes, said system comprising: a ballast for connection to a proper source of voltage, said ballast including a primary winding and a secondary winding, said ballast when connected to a proper source of voltage providing a voltage across said lamp, said ballast including a pair of electrode heater windings, at least one of said electrode heater windings comprising a portion of said secondary winding, a pair of semiconductor switches, each switch connecting one of said electrode heater windings to a respective lamp electrode, and control means coupled to said lamp and responsive to said voltage across said lamp when said lamp is on to render each said semiconductor switch non-conductive whereby no current can flow through said lamp electrodes, said control means being responsive to said voltage across said lamp when said lamp is off to render each said semiconductor switch conductive such that said pair of semiconductor switches conduct current which flows through said control means when said lamp is off.

2. A fluorescent lamp system according to claim 1, wherein said control means includes a semiconductor conducting device connected in parallel with said lamp and wherein current through said semiconductor conducting device renders said pair of semiconductor switches conductive.

3. A rapid start fluorescent lamp system comprising, a plurality of fluorescent lamps each having a pair of electrodes, a ballast for connection to a proper source of voltage, said ballast including a primary winding and a secondary winding, said ballast when connected to a proper source of voltage providing voltage across said lamps, said ballast including a plurality of electrode heater windings connected to said electrodes, at least one of said electrode heater windings comprising a portion of said secondary winding, a plurality of switches, one for each electrode heater winding, each switch connected between its associated electrode heater winding and an associated electrode, and control means connected across said lamps and responsive to said voltage across said lamps when said lamps are on to render each said switch non-conductive whereby no current can flow through said lamp electrodes, said control means being operable in response to said voltage across said lamps when said lamps are off to render each said switch conductive, voltage for operating at least one of said switches between its non-conducting state and its conducting state being supplied by the electrode heater winding to which said at least one switch is connected, wherein at least two of said plurality of switches conduct current which flows through said control means when said lamps are off.

4. A fluorescent lamp system according to claim 3, wherein said control means includes a semiconductor conducting device connected in parallel with said lamps and wherein current through said semiconductor conducting device renders said plurality of switches conductive.

5. A fluorescent lamp system according to claim 4, further comprising an optical coupler which electrically isolates at least one of said plurality of switches from the current through said semiconductor conducting device.

6. A fluorescent lamp system comprising a fluorescent lamp having a pair of electrodes, a ballast for connection to a proper source of voltage, said ballast including a primary winding and a secondary winding, said ballast when connected to a proper source of voltage providing voltage across said lamp, said ballast including a pair of electrode heater windings, at least one of said electrode heater windings comprising a portion of said secondary winding, a pair of semiconductor switches, each connecting one of said electrode heater windings to a respective lamp electrode, and control means connected across said lamp and responsive to said voltage across said lamp when said lamp is off to conduct current, said current rendering each said semiconductor switch conductive, said control means being responsive to said voltage across said lamp when said lamp is on to render each said semiconductor switch non-conductive whereby no current can flow through said lamp electrodes, and wherein said pair of semiconductor switches conduct current which flows through said control means when said lamps are off.

7. A fluorescent lamp system according to claim 6, wherein said control means includes a semiconductor conducting device connected in parallel with said lamp.

8. A rapid start fluorescent lamp system for a plurality of fluorescent lamps each having a pair of electrodes, said system comprising: a ballast for connection to a proper source of voltage, said ballast including a primary winding and a secondary winding, said ballast when connected to a proper source of voltage providing voltage across said lamps, said ballast including a plurality of electrode heater windings connected to said electrodes, at least one of said electrode heater windings comprising a part of said secondary winding, a plurality of witches, one for each electrode heater winding, each switch connected between its associated electrode heater winding and an associated electrode, and control means coupled to said lamps so as to conduct current when said lamps are off, said current rendering each said switch conductive, said control means being operable when said lamps are on to render each said switch non-conductive whereby no current can flow through said lamp electrodes, and wherein at least two of said plurality of switches conduct current which flows through said control means when said lamps are off.

9. A fluorescent lamp system according to claim 8, wherein said control means includes a semiconductor conductive device, said system including an optical coupler which electrically isolates one of said plurality of switches from the current through said semiconductor conductive device.

10. A rapid start fluorescent lamp system comprising, a plurality of fluorescent lamps each having a pair of electrodes, a ballast for connection to a proper source of voltage, said ballast including a primary winding and a secondary winding, said ballast when connected to a proper source of voltage providing voltage across said lamps, said ballast including a plurality of electrode heater windings connected to said electrodes, at least one of said electrode heater windings comprising a part of said secondary winding and another of said electrode heater windings comprising a part of said primary winding, a semiconductor switch for each electrode heater winding connected between its associated electrode heater winding and an associated lamp electrode, and control means connected across said lamps and responsive to said voltage across said lamps when said lamps are on to render each said semiconductor switch non-conductive whereby no current can flow through said lamp electrodes, said control means being operable in response to said voltage across said lamps when said lamps are off to render each said switch conductive, wherein at least two of said semiconductor switches conduct current which flows through said control means when said lamps are off.

11. A fluorescent lamp system according to claim 10, wherein said control means includes a semiconductor conducting device connected in parallel with said lamps and wherein current through said semiconductor conducting device renders said semiconductor switches conductive.

12. A fluorescent lamp system according to claim 11, wherein an optical coupler electrically isolates one of said semiconductor switches from the current through said semiconductor conducting device, control signals for the control electrode of said at least one semiconductor switch being generated from the electrode heater winding to which said at least one semiconductor switch is connected.

13. A fluorescent lamp system comprising a fluorescent lamp having a pair of electrodes, a ballast for connection to a proper source of voltage, said ballast including a primary winding and a secondary winding, said ballast when connected to a proper source of voltage providing voltage across said lamp, said ballast including a pair of electrode heater windings, a pair of semiconductor switches, each switch connecting one of said electrode heater windings to a respective lamp electrode, and control means connected across said lamp and responsive to said voltage across said lamp when said lamp is on to render each said semiconductor switch non-conductive in a manner whereby no current can flow through said lamp electrodes, said control means being responsive to said voltage across said lamp when said lamp is off to render each said semiconductor switch conductive in a manner whereby said pair of semiconductor switches conduct current which flows through said control means when said lamp is off.

14. A fluorescent lamp system according to claim 13, wherein said control means includes a semiconductor conducting device connected in parallel with said lamp and wherein current through said semiconductor conducting device renders said pair of semiconductor switches conductive.

15. A rapid start fluorescent lamp system comprising, a plurality of fluorescent lamps each having a pair of electrodes, a ballast for connection to a proper source of voltage, said ballast including a primary winding and a secondary winding, said ballast when connected to a proper source of voltage providing voltage across said lamps, said ballast including a plurality of electrode heater windings connected to said electrodes, a plurality of switches, one for each electrode heater winding, each switch connected between its associated electrode heater winding and an associated electrode, and control means connected across said lamps and responsive to said voltage across said lamps when said lamps are on to render each said switch non-conductive whereby no current can flow through said lamp electrodes, said control means being operable in response to said voltage across said lamps when said lamps are off to render each said switch conductive, voltage for operating at least one of said switches between its non-conducting state and its conducting state being supplied by the electrode heater winding to which said at least one switch is connected, wherein at least two of said plurality of switches conduct current which flows through said control means when said lamps are off.

16. A fluorescent lamp system according to claim 15 wherein said control means includes a semiconductor conducting device connected in parallel with said lamps and wherein current through said semiconductor conducting device renders said plurality of switches conductive.

17. A fluorescent lamp system according to claim 16, further comprising an optical coupler which electrically isolates at least one of said plurality of switches from the current through said semiconductor conducting device.

18. A fluorescent lamp system for a fluorescent lamp having a pair of electrodes, said system comprising: a ballast for connection to a proper source of voltage, said ballast including a primary winding and a secondary winding, said ballast when connected to a proper source of voltage providing voltage across said lamp, said ballast including a pair of electrode heater windings, a pair of semiconductor switches, each switch connecting one of said electrode heater windings to a respective lamp electrode, and control means coupled to said lamp so as to conduct current when said lamp is off, said current rendering each said semiconductor switch conductive, said control means being operable when said lamp is on to render each said semiconductor switch non-conductive whereby no current can flow through said lamp electrodes, and wherein said pair of semiconductor switches conduct current which flows through said control means when said lamps are off.

19. A fluorescent lamp system according to claim 18, wherein said control means includes a semiconductor conducting device connected in parallel with said lamp.

20. A rapid start fluorescent lamp system comprising, a plurality of fluorescent lamps each having a pair of electrodes, a ballast for connection to a proper source of voltage, said ballast including a primary winding and a secondary winding, said ballast when connected to a proper source of voltage providing voltage across said lamps, said ballast including a plurality of electrode heater windings connected to said electrodes, a plurality of switches, one for each electrode heater winding, each switch connected between its associated electrode heater winding and an associated electrode, and control means connected across said lamps and responsive to said voltage across said lamps when said lamps are off to conduct current, said current rendering each said switch conductive, said control means being operable in response to said voltage across said lamps when said lamps are on to render each said switch non-conductive whereby no current can flow through said lamp electrodes, and wherein at least two of said plurality of switches conduct current which flows through said control means when said lamps are off.

21. A fluorescent lamp system as claimed in claim 18 wherein said control means includes a voltage threshold element coupled between a control electrode of a first one of said semiconductor switches and a control electrode of a second one of said semiconductor switches.

22. A rapid start fluorescent lamp system as claimed in claim 20 wherein said control means includes a voltage threshold element coupled between a control electrode of a first one of said at least two semiconductor switches and a control electrode of a second one of said at least two semiconductor switches.

* * * * *